US009505517B2

(12) United States Patent
Yang

(10) Patent No.: US 9,505,517 B2
(45) Date of Patent: Nov. 29, 2016

(54) RECLOSABLE FOOD TRAY AND TRAY BLANK WITH YANG'S NOTCH CUT AS FASTENING MECHANISM; AND CARRYING STRAP FOR CARRYING SINGLE OR MULTIPLE FOOD TRAYS

(71) Applicant: Steven Song Yang, Wellesley, MA (US)

(72) Inventor: Steven Song Yang, Wellesley, MA (US)

( * ) Notice: Subject to any disclaimer, the term of this patent is extended or adjusted under 35 U.S.C. 154(b) by 220 days.

(21) Appl. No.: 13/772,237

(22) Filed: Feb. 20, 2013

(65) Prior Publication Data

US 2014/0231494 A1 Aug. 21, 2014

(51) Int. Cl.

| | |
|---|---|
| ***B65D 5/24*** | (2006.01) |
| ***B65D 5/20*** | (2006.01) |
| ***A45F 5/10*** | (2006.01) |
| ***B65D 5/46*** | (2006.01) |
| ***A45C 11/20*** | (2006.01) |
| *A45C 7/00* | (2006.01) |

(52) U.S. Cl.

CPC ..... *B65D 5/2047* (2013.01); *A45C 11/20* (2013.01); *A45F 5/10* (2013.01); *B65D 5/2061* (2013.01); *B65D 5/247* (2013.01); *B65D 5/46008* (2013.01); *A45C 2007/0013* (2013.01)

(58) Field of Classification Search

CPC ..... B65D 5/10; B65D 5/103; B65D 5/106; B65D 5/2057; B65D 5/2061; B65D 5/247; A45F 5/1026; A45F 2005/1033; A45F 2005/1066; A45F 5/10; A45F 5/102

USPC ..... 229/103.3, 114, 155, 186, 188, 194, 229/902, 906, 910, 911, 117.19, 117.24, 229/117.25, 117.26; 294/150, 151, 156

See application file for complete search history.

(56) References Cited

U.S. PATENT DOCUMENTS

| | | | | |
|---|---|---|---|---|
| 396,570 A | | 1/1889 | Hotchkiss | |
| 1,169,730 A | * | 1/1916 | Melville, Jr. | 294/151 |
| 1,187,496 A | * | 6/1916 | Bullock | 294/155 |
| 1,982,557 A | | 11/1934 | Watson | |
| 1,985,111 A | * | 12/1934 | Shofer et al. | 229/117.05 |
| 2,330,521 A | | 9/1943 | Scheide | |
| 2,341,762 A | * | 2/1944 | Conklin | 229/117.14 |
| 2,364,267 A | * | 12/1944 | Buttery | 229/147 |
| 2,391,767 A | | 12/1945 | Beerend | |

(Continued)

FOREIGN PATENT DOCUMENTS

| | | | | |
|---|---|---|---|---|
| CA | 626234 A | | 8/1961 | |
| FR | 572219 | * | 2/1924 | B65D 5/2061 |

(Continued)

*Primary Examiner* — Gary Elkins

(74) *Attorney, Agent, or Firm* — Daly, Crowley, Mofford & Durkee, LLP

(57) ABSTRACT

A reclosable food tray is disclosed comprising a receptacle portion and two pairs of opposing closure flaps. The receptacle portion has substantially trapezoidal volume defined by a rectangular shaped bottom panel and two substantially upstanding pair of opposing side panels. The opposing side panels defined four pairs of adjacent panels which are hingedly connected in liquid-sealed manner by four folded gussets secured by three pairs of notch cuts. The notch cut is a curved and hook-like cut serves as interlocking mechanism to hold the food tray together. The pair of notch cuts can also be disconnected from each other to open the panel(s). The notch cut enable the food tray shipping in blank and erected by end user, also eliminates metal wire and adhesives that are commonly used by prior arts. A carrying strap purposely designed for carrying one or multiple food tray is a component of the invention.

9 Claims, 9 Drawing Sheets

(56) References Cited

U.S. PATENT DOCUMENTS

| | | | | | |
|---|---|---|---|---|---|
| 2,475,294 | A | | 7/1949 | Rafoth | |
| 2,528,016 | A | | 10/1950 | Smith | |
| 2,676,747 | A | | 4/1954 | Lange | |
| 2,801,930 | A | | 8/1957 | Paulucci | |
| 2,810,506 | A | | 10/1957 | Kessler | |
| 2,917,221 | A | | 12/1959 | Risdon | |
| 3,027,063 | A | | 3/1962 | Zastrow | |
| 3,043,068 | A | | 7/1962 | Blonder | |
| 3,128,725 | A | | 4/1964 | Becker et al. | |
| 3,146,933 | A | | 9/1964 | Moore | |
| 3,155,304 | A | | 11/1964 | Beerend | |
| 3,352,472 | A | | 11/1967 | Cummings et al. | |
| 3,542,569 | A | | 11/1970 | Farquhar | |
| 3,771,713 | A | | 11/1973 | Davidson | |
| 3,863,832 | A | | 2/1975 | Gordon et al. | |
| 3,871,357 | A | | 3/1975 | Grosso et al. | |
| 3,913,823 | A | | 10/1975 | Lin | |
| 3,934,919 | A | * | 1/1976 | Smith | 294/74 |
| 3,983,256 | A | | 9/1976 | Norris et al. | |
| 4,036,423 | A | | 7/1977 | Gordon | |
| 4,202,465 | A | | 5/1980 | McLaren | |
| 4,253,602 | A | | 3/1981 | Kulig | |
| 4,277,506 | A | | 7/1981 | Austin | |
| 4,279,933 | A | | 7/1981 | Austin et al. | |
| 4,304,335 | A | | 12/1981 | Bemiss | |
| 4,308,985 | A | | 1/1982 | Manizza et al. | |
| 4,571,340 | A | | 2/1986 | Ferrante et al. | |
| 4,754,914 | A | | 7/1988 | Wischusen, III | |
| 4,757,940 | A | | 7/1988 | Quick et al. | |
| 4,917,291 | A | * | 4/1990 | Saiki et al. | 229/155 |
| 4,930,639 | A | | 6/1990 | Rigby | |
| 5,411,204 | A | | 5/1995 | DeMay | |
| 5,458,270 | A | * | 10/1995 | Tsao | 229/114 |
| 5,484,182 | A | * | 1/1996 | Meisner | 294/165 |
| 5,873,220 | A | | 2/1999 | Haraldsson et al. | |
| 6,050,483 | A | | 4/2000 | Haraldsson et al. | |
| 2004/0182916 | A1 | * | 9/2004 | Roseth | 229/155 |
| 2011/0049922 | A1 | * | 3/2011 | Burrell | 294/161 |

FOREIGN PATENT DOCUMENTS

| | | | | | |
|---|---|---|---|---|---|
| FR | 1405944 | A | | 7/1965 | |
| FR | 2545713 | A1 | * | 11/1984 | A45F 5/10 |
| GB | 2257959 | A | * | 1/1993 | 229/194 |

* cited by examiner

RECLOSABLE FOOD TRAY AND TRAY BLANK WITH YANG'S NOTCH CUT AS FASTENING MECHANISM; AND CARRYING STRAP FOR CARRYING SINGLE OR MULTIPLE FOOD TRAYS

BACKGROUND OF THE INVENTION

1. Field of Invention

The present invention generally relates to a preconstructed folding food tray which is adapted to open and close easily and, more particularly, to a foldable tray blank and method of erecting the blank to form the constructed tray. The present invention is an improvement of the prior art invented by DeMay and filed with the US Patent & Trademark Office in 1995, U.S. Pat. No. 5,411,204.

2. Brief Description of the Prior Art

Fast, convenient take-out and prepared food services have become a way of life in modern society. There many food trays, containers have been made and distributed to retails where food are served and delivered. Furthermore, many gift shops have used verity of such containers as gift wrapping and decorations. The most commonly used food tray is the Chinese food pail that is universally known in the take-out food industry. It is preconstructed at the manufacturing plant by folding a precut blank and fastening the gusset flaps with glue or metallic wire. Commercial products of this type have been offered by Fold-Pak Corporation since approximately 1977. Hundreds of millions such food pails are manufactured and distributed worldwide annually.

The food pails fastened by adhesive (glue) are easily break open during stacking and shipping and adhesive is deposited on the interior surface of the blank, specifically between the adjacent panels which form each corner of the carton. When exposed to high temperature, this adhesive can cause undesirable contamination of the contents and once opened, it is quite a hassle to reclose. Those that are using metal wire are not microwave resistant if the metal wire is not removed, as well, it is not convenient to open for pouring out of food or use it as disposable dinning container. Without opening the tray, food or contents is almost invisible from other angles unless directly peak from top opening. In addition, they all are pre-constructed at manufactures and take certain amount of space for packaging, shipping and storing. The DeMay's 1990 invention of the recloseable food tray only offered the previously existing food pail a top recloseable panels. The present invention permits the food pail re-open and reclose from both top and side as end user desires.

This disclosure indicates a clear need for a folding food carton which overcomes the deficiencies of earlier art-recognized techniques. Furthermore, the current computer guided precision cut and laser cut technologies have made the present invention easily manufactured and cost effective possible.

Accordingly, it is a primary object of the present invention to provide a blank, reclosable food tray which is substantially leak-proof and adapted for exposure to microwave and other high temperature applications.

It is another object of the present invention to provide a convenient, reusable container for an assorted selection of take-out and prepared foods Another object is to provide a food tray which can be shipped in blank to the end user. It is cost effective on manufacturing, wrapping, shipping and storing.

It is a further object of the present invention to provide a food tray which has improved operability and improved "closeability" and which affords improved protection to the food contents after reclosing.

Another object is to provide an easy reopen/recloseable container that make the content transferred from, or to other containers easily. As well, make food or content in tray more visible from opening.

A further object of the present invention is to provide a container that can be easily opened and served as a temporary, informal food plate and make-shift dinning containers for casual occasions.

A further object of the present invention is to provide folding tray blanks which can be constructed in a simple and efficient manner. Optimally, it can be stored as tray blank and constructed by end user at last minute when needed.

Another object of the present invention is to provide tray blanks of varying configurations which are adapted with cuts and score lines to form an assembled tray container for take-out and prepared foods.

Another object of the present invention is to provide an environmentally attractive food tray made from biodegradable material. Less material is used, less energy consumed when manufacturing it. In result, less packing material and less cargo space when shipping.

A further object of the present invention is to provide tray blanks which are adapted for manufacture from paperboard sheet stock using high-speed cutting and scoring machines.

It is a further object of the present invention to provide tray blanks using a minimum amount of stock during the cutting and scoring operations.

A further object of the present invention is to provide a method of erecting the food tray without high speed operations involved.

Another object of the present invention is to provide end user a carrying strap that is capable carrying multiple containers at same time as very commonly that people taking out several different food containers on a single trip.

A further objective of the present invention is to minimize, or even eliminate, the usage of extra brown, plastic bags that are commonly provided to host multiple containers.

A further objective of the present invention is to expose exterior surface which could be utilized for retail logos, advertisements, art work/decoration, identification marks and social awareness communications, etc.

Based on this disclosure, additional objects of the present invention will be apparent to those with ordinary skill in the pertinent art.

SUMMARY OF THE INVENTION

A reclosable food tray is provided by one aspect of the present invention. The tray is constructed from a single unitary blank, and comprises a receptacle portion and first and second pair of opposing closure flaps.

The receptacle portion has access openings, from top or from side, which permits introduction of food. Its volume is defined by a rectangular shaped bottom panel and two substantially upstanding pair of opposing side panels. The two pair of opposing side panels extend substantially upright from the bottom panel and define four pair of adjacent side panels at the corners of the bottom panel. Each pair of adjacent side panels are hingedly connected in a liquid-sealed manner, by a folded gusset unitary with the respective adjacent side panels, and is secured by said notch cuts on the folded gussets. The first pair of opposing closure flaps that have said notch cut extend from one pair of opposing side panels and are capable of covering or closing off a portion of the access opening. The second pair of opposing closure flaps that have said notch cut extend from the other pair of opposing side panels and are interlocked by said notch cuts to cooperate with each other, overlap a portion of the first pair of opposing closure flaps that can be interlocked by said notch cut, and cover the remaining portion of the access opening. Each folded gusset is suitably dimensioned so that the receptacle portion is capable of retaining liquids or semi-solid consumables without leakage. Each folded gusset is also bearing said notch cut that serves as interlock mechanism to hold the tray in shape.

In the preferred embodiment, the food tray is erected from a paperboard or stiff plastic material which is substantially resistant to microwave and other heat radiation. With the food tray of the present invention, food can be safely and efficiently heated in a microwave or convection oven.

According to another aspect of the present invention, a tray blank is provided having a planar unitary construction and a substantially rectangular gross geometry. The blank generally comprises a bottom panel; first and second pair of opposing side panels; four foldable gussets with said notch cut and first and second pair of opposing closure panels with said notch cut.

The bottom panel has a rectangular shape and a surface area defined by a first and second pair of opposing bottom fold lines. The first and second pair of opposing side panels are hingedly connected to the bottom panel at the first and second pair of opposing bottom fold lines, respectively. These opposing panels define four pair of adjacent side panels, each adjoining at a corner of the bottom panel. Each foldable gusset is hingedly connected to each pair of adjacent side panels. When the first and second opposing side panels are folded substantially upright with respect to the bottom panel, the tray receptacle with an access opening is formed; each gusset is folded adjacent toward an exterior portion of one side panel and interlock with an opposing gusset through said notch cuts. With said notch cut on said gusset, it permits gussets detach from each other that also permits one side panel tilt open as side receptacle access. Each side panel is disposed substantially upright at a predetermined obtuse angle with respect to the bottom panel.

The first pair of opposing closure panels is hingedly connected to the first pair of opposing side panels. Each closure panel has a said notch cut at its top edge, is adapted to close off a portion of the access opening when folded and disposed substantially parallel to the bottom panel. The second pair of opposing closure panels is hingedly connected to the second pair of opposing side panels, and adapted to overlay a portion of the first pair of opposing closure panels and close off the remaining portion of the access opening through said notch cut. A fastening means may be provided for selectively opening and closing the second pair of closure panels.

Another aspect of the present invention concerns a novel method of erecting a food tray from a blank in a simple, yet highly efficient manner with a minimum number of folding operations.

BRIEF DESCRIPTION OF THE DRAWINGS

Reference is made to the following description of the preferred embodiment in connection with the accompanying drawings. With FIG. 1 as the reference, all the numbers and letters on different illustrations of the first present invention, the food tray, are intent to be consistent with FIG. 1; With FIG. 7 as the reference, all the letters and numbers on different illustrations of the second present invention, the carrying strap, are intend to be consistent with FIG. 7, wherein.

Figure 1:
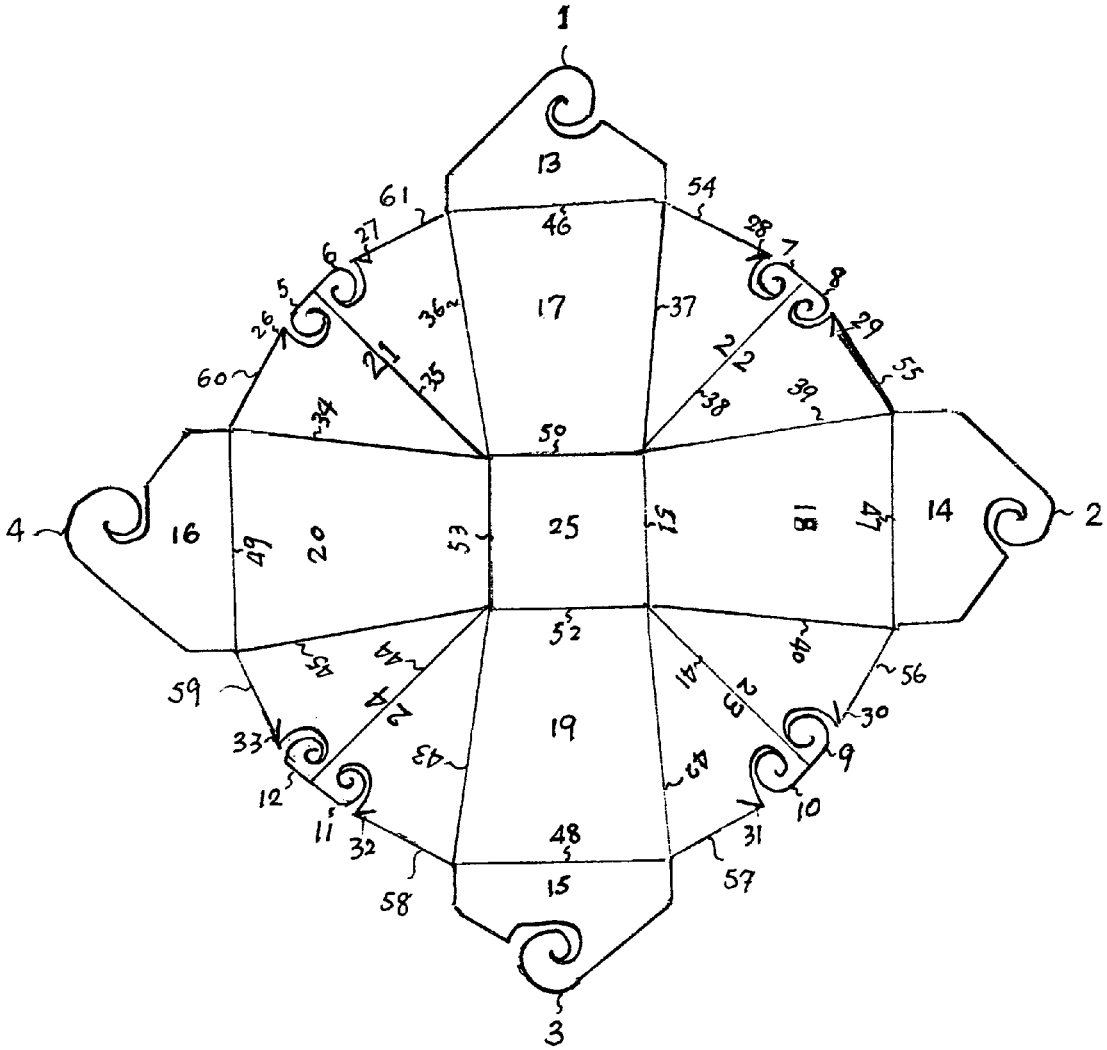
FIG. 1 is a plan view of the new and improved tray blank of the present invention.

1, 2, 3 and 4 are the notch cut on top closure panels; 5 through 12 are the notch cuts in back to back fashion on gussets 21, 22, 23 and 24; 26 through 33 are optional short line cut that associate with the notch cuts for easy insertion and security of the notch cut when erected the tray blank to shape; 25 is the bottom panel; 17, 18, 19 and 20 are substantially upstanding side panels; 13, 14, 15 and 16 are closure panels; 34 through 53 are foldable lines; 54 through 61 are angle edges of closure panels.

Figure 2:
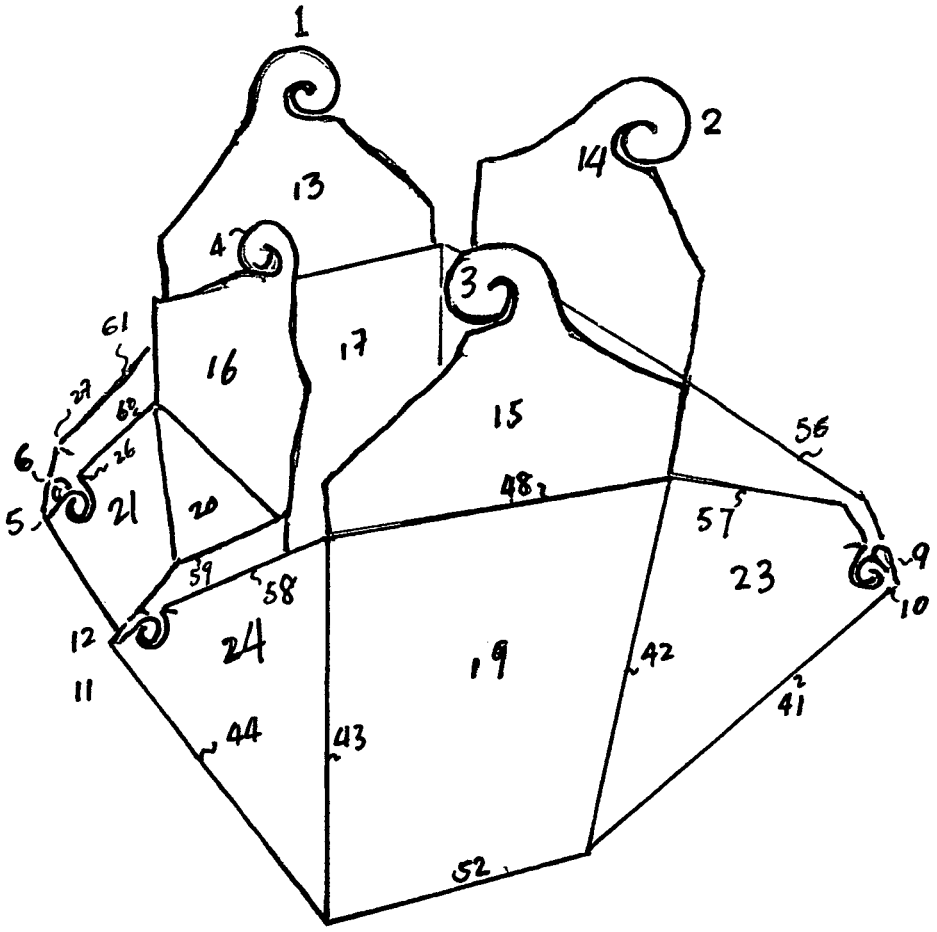

FIG. 2 is a perspective view of the new and improved tray, in erected and half-way enclosed stage of the present invention; it illustrates the second stage of erecting a tray blank to tray container. Visible notch cuts, 5, 6, 9, 10, 11 and 12 on visible gussets 21, 23 and 24; notch cuts 1, 2, 3 and 4 on closure panels 13, 14, 15 and 16. All the notch cuts are not yet hooked into each other to fully close the food tray at this stage.

Figure 3:
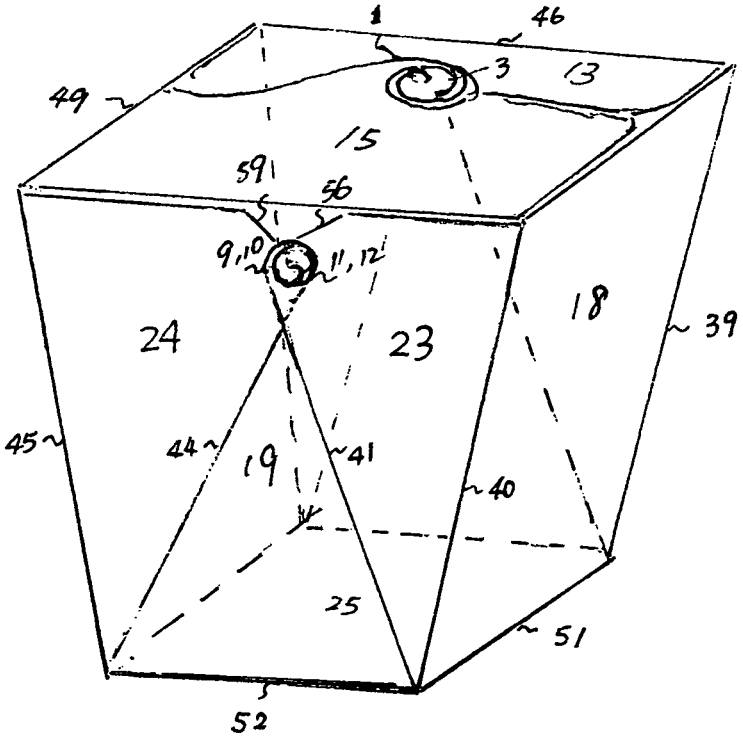
Figure 4:
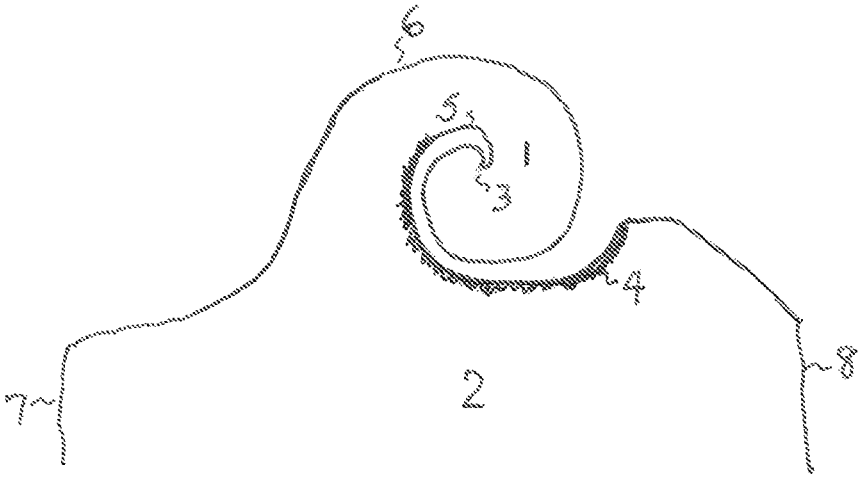

FIG. 3 is a perspective view of the tray blank after completely folded to form the food tray of the present invention, being shown in its erected position ready for stacking with other like trays and ready to be carried by the second invention, the carrying strap, described in said claim 24 above;

FIG. 4 is a detailed plan view of one notch cut 1, in 2, one of the four closure gussets; Inner loop line 5 and outer loop line 6 merge into each other at tip point 3; 4 is optional rough edge (zigzag or teeth like lines) on inner loop line 5 to increase friction for more security when notch cut intertwined. Inner loop line 5 can be a smooth loop line without rough edge. This drawing illustrates only partial closure panel.

Figure 5:
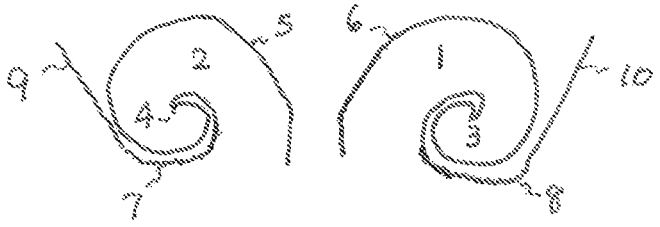

FIG. 5 is a detailed plan view of the notch cut 1 and 2 on opposite side of gussets that have been folded together along folding line, but before hook into each other.

Figure 6:
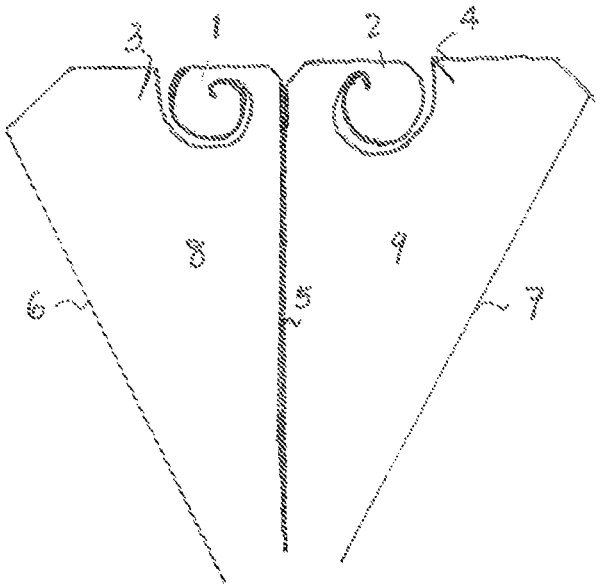

FIG. 6 is detailed plan view of one foldable gusset with two notch cuts 1 and 2 are in back to back position before folding lines pressed. The two sections 8 and 9 divided by foldable line 5 are in equal size and mirror images. 3 and 4 represent the short line cut for more security after two notch cuts intertwined. When folded, the two sections 8 and 9 will become one section with two identical layers (see 9 and 10 in FIG. 7).

Figure 7:
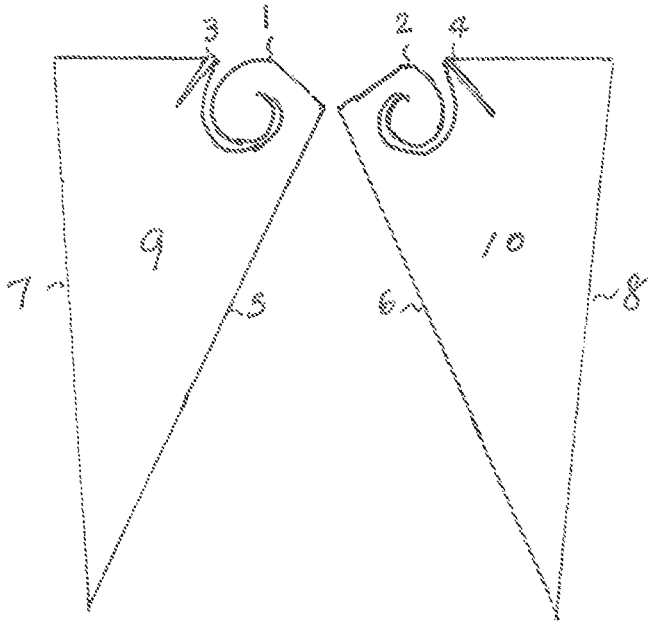

FIG. 7 is a detailed plan view of two gussets after folded becoming double layers, before intertwined to connect. 1 and 2 are the notch cuts with two layers on two opposite gussets; 3 and 4 are short cuts with two layers; 9 and 10 are two opposite gussets after folded the illustration as FIG. 6.

Figure 8:
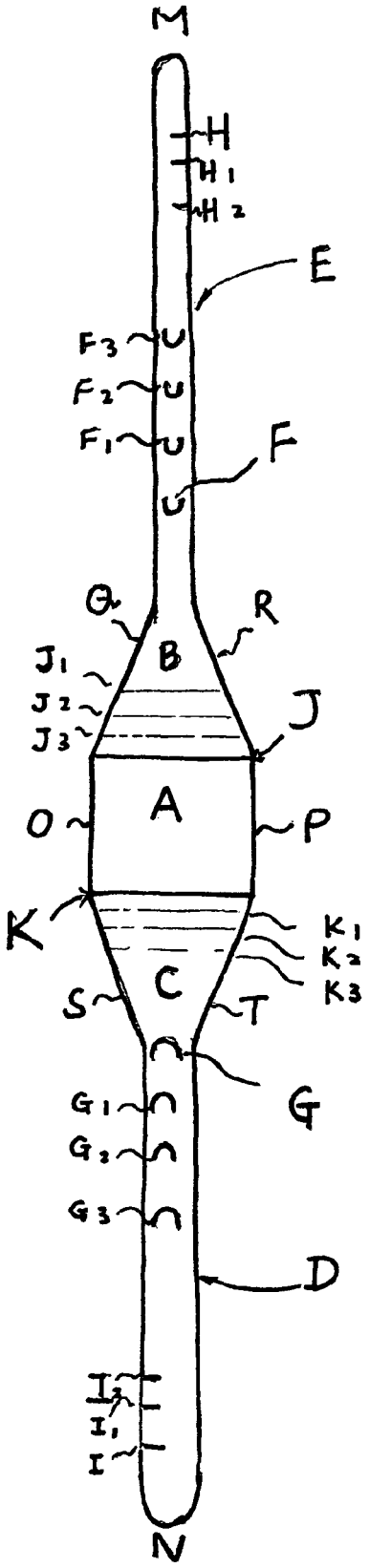

FIG. 8 is a plan view of the new invention, the carrying strap, designed to carry single and/or multiple the new and improved food tray. Bottom rectangle panel A; triangle panels B and C; foldable lines J, J1, J2, J3, K, K1, K2 and K3 (folding lines can be selected based on needs); fish scale cut F, F1, F2, F3, G, G1, G2 and G3 (scale cut can be more or less based on needs); strap on opposite end E and D; short line cut H, H1, H2, H3, I, I1, I2 and I3 (short line can be selected based on needs); round tip M and N; O, P, Q, R, S and T are edge lines.

Figure 9:
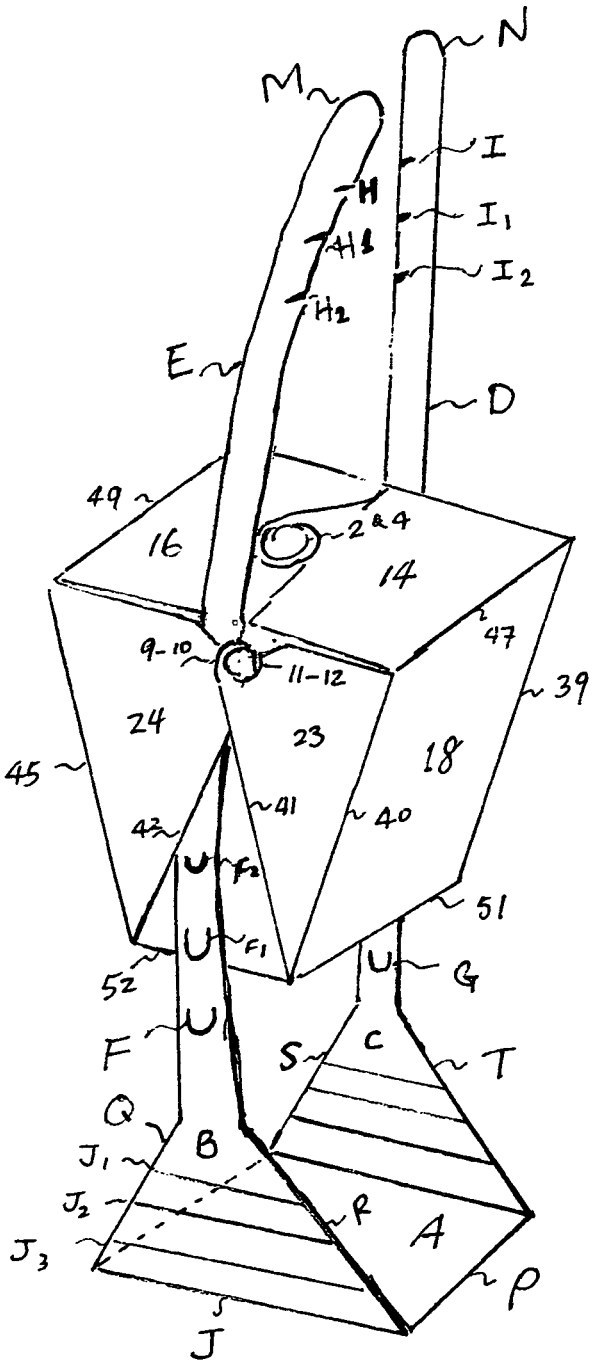

FIG. 9 is a perspective view of the erected carrying strap with one said food tray sliding down toward to the bottom panel of, the carrying strap.

Figure 10:
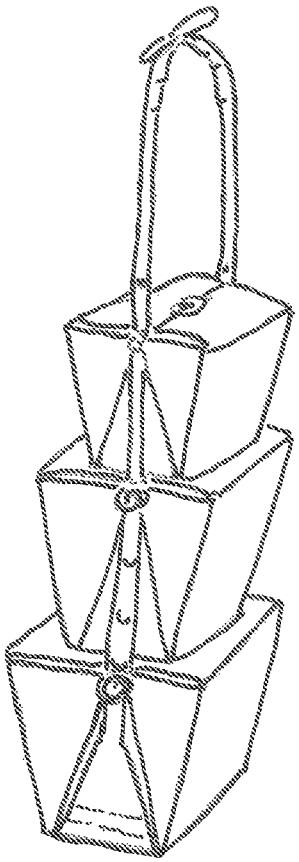

FIG. 10 is a perspective view of multiple of the first present invention, the food tray fully erected and stacked in a fully erected and looped the carrying strap.

OPERATION

Numbers Below Referred to FIG. 1

1) Erect the pre-cut, pre-shaped flat single unitary blank paper/plastic sheet to box shape. Press the blank sheet along folding lines 34 through 53;
2) Push first pair of foldable gussets 21 and 22, and then second pair 23 and 24 toward to each other until they overlap to each other;
3) Gently twist and wiggle to snap double layered notch cuts, 5 and 6 pair to 7 and 8, then 9 and 10 pair to 11 and 12, into each other;
4) Pull back gently to make sure the two said notch cuts snug tightly and intertwined;
5) Put food or other contents into the food tray; (Note: food or contents can be introduced through unclosed side panel that has foldable gussets that are enclosed by the notch cuts.)
6) Close the first pair of re-closable top closure panels 13 and 15 and then, 14 and 16, by notch cuts as described in Step 3 and 4 to close the tray;
7) Erect the second present invention, the carrying strap, from blank. Fold it along the foldable line to adjust bottom panel A to match the size of bottom panel of the food tray;
8) Slide in the carrying strap, from bottom to top, between intertwined two pairs of foldable gussets, 21 & 22 and 23 & 24 that have been connected and interlocked by the notch cuts. Alternately, fold and interlock the guests after the carrying strap is in position;
9) Lock the carrying strap at two ends by using short line cut, H and I, into each other;
10) Push inward the fish scale cut(s), G and F, on the straps D and E, to add extra stability and security while carrying the food tray. The purpose of the fish scale cuts is to minimize trays' movement.
11) To access food or contents of the tray, remove food tray(s) from the carrying strap;
12) Twist and unlock the notch cut to reopen the food tray from side or from top.

REFERENCE

U.S. Provisional Patent Application 61/633,793, Filed Feb. 18, 2013 Receipt Date: Mar. 5, 2012

U.S. Patent Documents

| | | |
|---|---|---|
| 396,570 | January 1889 | Hotchkiss |
| 1,169,730 | January 1916 | Melville, Jr. |
| 1,187,496 | June 1916 | Bullock |
| 1,982,557 | November 1934 | Watson |
| 1,985,111 | December 1934 | Shofer Marc R |
| 2,330,521 | September 1943 | Scheide |
| 2,341,762 | February 1944 | Conklin Alfred R |
| 2,364,267 | December 1944 | Buttery Kenneth T |
| 2,391,767 | December 1945 | Beerend |
| 2,475,294 | July 1949 | Rafoth |
| 2,528,016 | October 1950 | Smith |
| 2,676,747 | April 1954 | Lange |
| 2,801,930 | August 1957 | Paulucci |
| 2,810,506 | October 1957 | Kessler |

-continued

| | | |
|---|---|---|
| 2,917,221 | December 1959 | Risdon |
| 3,027,063 | March 1962 | Zastrow |
| 3,043,068 | July 1962 | Blonder |
| 3,128,725 | April 1964 | Becker et al. |
| 3,146,933 | September 1964 | Moore |
| 3,155,304 | November 1964 | Beerend |
| 3,352,472 | November 1967 | Cummings et al. |
| 3,542,569 | November 1970 | Farquhar |
| 3,771,713 | November 1973 | Davidson |
| 3,863,832 | February 1975 | Gordon et al. |
| 3,871,357 | March 1975 | Grosso et al. |
| 3,913,823 | October 1975 | Lin |
| 3,934,919 | January 1976 | Smith Arthur W |
| 3,983,256 | September 1976 | Norris et al. |
| 4,036,423 | July 1977 | Gordon |
| 4,202,465 | May 1980 | McLaren |
| 4,253,602 | March 1981 | Kulig |
| 4,277,506 | July 1981 | Austin |
| 4,279,933 | July 1981 | Austin et al. |
| 4,304,335 | December 1981 | Bemiss |
| 4,308,985 | January 1982 | Manizza et al. |
| 4,571,340 | February 1986 | Ferrante et al. |
| 4,754,914 | July 1988 | Wischusen, III |
| 4,757,940 | July 1988 | Quick et al. |
| 4,917,291 | April 1990 | Saiki et al |
| 4,930,639 | June 1990 | Rigby |
| 5,411,204 | May 1995 | DeMay |
| 5,458,270 | October 1995 | Tsao Chung-Piao |
| 5,484,182 | January 1996 | Meisner Edward H |
| 2004/0182916 | September 2004 | Roseth, Steven H |
| 2011/0049922 | March 2011 | Burrell George T |

Foreign Patent Documents

| | | | |
|---|---|---|---|
| 572,219 | February 1924 | | FR |
| 626,234 | August 1961 | | CA |
| 1,405,944 | June 1965 | | FR |
| 2,545,713A1 | November 1984 | | FR |
| 2,257,959A | January 1993 | Randall | GB |

OTHER REFERENCES

Fold-Pak, Chinese Food Pail Blank No. 1J, 1977.

What is claimed is:

1. A reclosable food tray erected from a single unitary blank having an interior and exterior surface, a substantially square gross geometry and curved looped hook-like notch cuts as fastening and interlocking mechanisms which allows the food tray, without assistance of adhesive or metal wire, to be shipped as a blank, erected and shaped by an end user and to be opened and reclosed from both the top and sides of the food tray;

said food tray comprising:

a fully constructed receptacle portion having access openings from the top or the side permitting introduction of food into said receptacle portion, said receptacle portion having a volumetric geometry defined by a rectangular shaped bottom panel, a first substantially upstanding pair of opposing side panels and a second substantially upstanding pair of opposing side panels; said opposing side panels defining four pairs of adjacent side panels with each pair of adjacent side panels being hingedly connected by one of four folded gussets, each said gusset being unitary with one said pair of adjacent side panels, each said gusset including said notched cuts and short cut lines which allows said gusset to be secured and interlocked with an opposing one of the four folded gussets, each said side panel being disposed at a first obtuse angle measured from the bottom panel so that said volumetric capacity facilitates nesting of the receptacle portion of said food tray with a receptacle portion of another reclosable food tray;

each of said curved looped hook-like notch cuts comprising an inner loop line, an outer loop line, a tip point where the outer and inner loop lines curve and merge together and optional teeth-like rough edges along the inner loop line wherein said inner loop lines serve the purpose of providing more security to secure the food tray, said notch cuts being capable of hooking and unhooking into each other permitting the food tray to reclose and reopen;

a pair of opposing closure flaps each extending from one of said first pair of opposing side panels and each including one of said notch cuts, a second pair of opposing closure flaps each extending from one of said second pair of opposing side panels and each closure flaps each including one of said notch cuts, said first pair of closure flaps adapted to cooperatively interlock and close off a portion of the top access opening and said second pair of closure flaps adapted to overlap a portion of the first closure flaps, interlock together and close off the top access opening.

2. The reclosable food tray of claim 1, wherein each said folded gusset is suitably dimensioned so that said receptacle portion is capable of retaining liquid or semi-solid consumables without leakage through said receptacle portion.

3. The closable food tray of claim 2, wherein said two substantially upstanding pair of opposing side panels comprise a first side panel disposed opposite a second side panel, a third side panel disposed opposite a fourth side panel, with said first side panel being adjacent said third and said fourth side panels and said second side panel being adjacent said third and fourth side panels to form a volume having trapezoidal dimensions.

4. The reclosable food tray of claim 1, wherein said blank comprises paperboard material which is substantially resistant to microwave and other heat radiation.

5. The reclosable food tray of claim 1, wherein said first pair of opposing closure flaps are hingedly connected to said respective opposing side panel salong respective top fold lines, and each folded gusset has an upper edge which extends substantially along one of said respective top fold lines.

6. The reclosable food tray of claim 5, wherein said first and second pair of opposing side panels are hingedly connected to said bottom panel along respective bottom fold lines, and each said side panel has left and right side fold lines, each of which are disposed at a second obtuse angle with respect to adjacent bottom fold lines.

7. The reclosable food tray of claim 6, wherein said blank comprises paperboard material which is substantially resistant to microwave and other heat radiation.

8. The reclosable food tray of claim 1, which further comprises a folded partition for insertion into said receptacle portion to divide said receptacle portion into two or more separate food storage compartments.

9. A carrying strap for carrying a plurality of food trays, each food tray as set forth in claim 1, said carrying strap being formed from a single unitary blank comprising:

a rectangular shaped bottom panel;

two isosceles trapezoidal upstanding sides each connected to an opposing side of said rectangular shaped bottom panel;

two long narrow substantially rectangular shaped extended strap portions each connected to one of said upstanding sides along an upper edge of the upstanding side, said strap portions each including line cuts at one end allowing said strap portions to engage each other to form a carrying strap, said strap portions further including fish scale cuts strategically punched along the strap portion to engage and retain said trays within the carrying strap during use.

* * * * *